US006823073B2

(12) United States Patent
de Roo

(10) Patent No.: US 6,823,073 B2
(45) Date of Patent: Nov. 23, 2004

(54) DIRECTIONAL MICROPHONE ASSEMBLY

(75) Inventor: Dion Ivo de Roo, Leidschendam (NL)

(73) Assignee: Sonionmicrotronic Nederland B.V., Amsterdam (NL)

( * ) Notice: Subject to any disclaimer, the term of this patent is extended or adjusted under 35 U.S.C. 154(b) by 365 days.

(21) Appl. No.: 09/764,060

(22) Filed: Jan. 19, 2001

(65) Prior Publication Data

US 2001/0008559 A1 Jul. 19, 2001

(30) Foreign Application Priority Data

Jan. 19, 2000 (DK) ..... 2000 00085

(51) Int. Cl.[7] ..... H04R 3/00
(52) U.S. Cl. ..... 381/92; 381/111; 381/122
(58) Field of Search ..... 381/92, 94.7, 122, 381/111

(56) References Cited

U.S. PATENT DOCUMENTS 4,354,059 A 10/1982 Ishigaki et al.
4,509,193 A 4/1985 Carlson
5,524,056 A 6/1996 Killion et al.
5,796,848 A 8/1998 Martin
6,389,142 B1 * 5/2002 Hagen et al. ..... 381/313
6,539,096 B1 * 3/2003 Sigwanz et al. ..... 381/313

FOREIGN PATENT DOCUMENTS

EP 0848573 6/1998
EP 0942628 A2 * 9/1999 ..... H04R/25/00
JP 361191110 A * 8/1986 ..... H03H/11/26
JP 405347793 A * 12/1993 ..... H04R/3/00
JP 6-90493 3/1994
JP 05347793 4/1994

* cited by examiner

*Primary Examiner*—Melur Ramakrishnaiah
(74) *Attorney, Agent, or Firm*—Harness Dickey & Pierce P.L.C.

(57) ABSTRACT

The present invention relates to a directional microphone assembly comprising a front and a rear microphone for compact communication devices, such as hearing aids, mobile phones etc. The present invention integrates most or all electronic processing circuits required to form a directional microphone output signal using a front and a rear microphone signal. Accordingly, the directional microphone assembly according to the present invention occupies less volume compared to traditional microphone assemblies.

18 Claims, 2 Drawing Sheets

DIRECTIONAL MICROPHONE ASSEMBLY

FIELD OF THE INVENTION

The present invention relates to a directional microphone assembly comprising a front and a rear microphone for application in electronic equipment, particularly compact communication devices, such as hearing aids, mobile phones etc. The present directional microphone assembly integrates most or all electronic processing circuits required to form a directional microphone output signal from a front and a rear microphone signal. Accordingly, the present directional microphone assembly occupies less volume within the compact communication devices than traditional directional microphones and further permits an equipment manufacturer to save discrete or integrated components or die area of an integrated circuit processing the microphone signals.

BACKGROUND OF THE INVENTION

Electronic equipment manufacturers continuously strive toward developing smaller communication devices, such as mobile phones, hearing aids, head-sets and other head-worn or body-worn devices, with more and more features. This development is helped by a continuous reduction in size of all components commonly utilised in such communication devices and by providing these components with an increased number of integrated features. In the field of hearing aids or instruments, the size of today's hearing aid microphones causes these to occupy a significant volume of a hearing aid housing. Accordingly, it is advantageous to minimise the size of the microphone or microphones employed within the hearing aid.

Hearing aid users often experience difficulty in understanding conversational speech in the level of background noise present in everyday situations such as conversations in homes, office buildings, department stores etc. It is well-known that this difficulty to some extent can be helped by employing a directional hearing aid on the hearing impaired individual. Such a directional hearing aid will commonly be adjusted so as to attenuate signals arriving from a side and back hemisphere of the individual with respect to frontally arriving signals, since is must be assumed that the individual faces a person or sound source with whom/which to communicate.

Such directional hearing aids have traditionally been equipped with a directional microphone that comprises two sound inlet ports spaced a distance apart and conveying the sounds from both inlet ports to a common microphone element responding to the difference between sound pressures of the inlet ports. The rear sound inlet is further provided with an acoustical delay element providing a fixed time delay to the rear sound signal that approximately equals the acoustic time delay between the inlet ports or equals a certain fraction of the acoustic time delay between the inlet ports. Accordingly, the signals arriving from the back are attenuated compared to signals arriving from the front in accordance with the directional pattern of the directional microphone, and the desired attenuation of interfering sounds/noise arriving from the side and rear may be provided.

However, such directional microphone constructions inherently attenuate low frequency signals independent of their direction of arrival and this often leads to an unnatural and fatiguing sound quality of the signal provided to the hearing impaired individual. Thus, it would be advantageous to provide a microphone assembly wherein the directional operation could be switched off and omni-directional operation employed in listening situations with little or no background noise.

Furthermore, traditional directional microphones occupy a significant amount of volume due to the need for the two inlet ports and their associated tubing carrying the sound signals from the inlet ports to a microphone element.

U.S. Pat. No. 5,524,056 discloses a hearing aid that comprises an omni-directional microphone and at least one directional microphone and an associated switching system which, manually or automatically can switch between utilising the omni-directional microphone or the at least one directional microphone. The automatic switching between the microphones may be controlled in response to a sensed level of background noise.

SUMMARY OF THE INVENTION

It is an object of the invention to provide a directional microphone assembly comprising a front and a rear microphone that occupies less space than traditional directional microphones or combinations of directional microphones and omni-directional microphones.

It is also an object of the invention to provide a directional microphone assembly wherein an electronic time delay circuit and a summing circuit or unit is fully or partly integrated in one of the microphones.

In a first aspect, the present invention relates to a directional microphone assembly comprising:

- a front microphone comprising a first electronic processing circuit, said front microphone being adapted to receive and convert sound waves into a front microphone signal,
- a rear microphone comprising a second electronic processing circuit, said rear microphone being adapted to receive and convert sound waves into a rear microphone signal, wherein the first or second electronic processing circuit comprises an electronic time delay circuit adapted to time delay the rear microphone signal with respect to the front microphone signal, and to receive a microphone signal so as to generate a directional microphone output signal.

The directional microphone assembly preferably comprises a pair of matched microphones in the form of the front and rear microphones. Since the attenuation of sound signals arriving from the rear direction in the directional microphone output signal is caused by the cancellation of two oppositely phased microphone signals of substantially equal amplitude provided by the front and the rear microphones, the matching of the microphones frequency responses must be considered. To provide a satisfactory attenuation of rear sound signals in the hearing aid, it has been found that the microphones amplitude responses must be matched to about 1 dB or less in the frequency range from 200 Hz–4000 Hz and the phase responses must be matched to about 2 degrees in the same frequency range. To achieve a satisfactory directionality in the low frequency range, below 500 Hz, it may be required to match the microphones amplitude responses to less than about 0.5 dB such as about 0.2 dB. Furthermore, since the microphone signals are processed by their respective electronic processing circuits before the directional microphone signal is formed in one of the electronic processing circuits, strict matching requirements may also be needed between these electronic processing circuits in the pair of matched microphones.

The electronic processing circuit of the front microphone or of the rear microphone must be adapted to receive a signal from the other microphone to generate the directional microphone signal. Accordingly, the rear microphone and its electronic processing circuit may be adapted to delay the rear microphone signal and to receive and combine the front microphone signal with a delayed rear microphone signal to generate the directional microphone signal. This directional microphone signal is preferably conveyed to an externally accessible output terminal of the rear microphone. Alternatively, the front microphone and its electronic processing circuit may be adapted to receive and delay the rear microphone signal and combine the delayed rear microphone signal with the front microphone signal to generate the directional microphone signal.

According to a preferred embodiment of the invention, the first electronic processing circuit of the front microphone comprises the electronic time delay circuit and is further adapted to receive the rear microphone signal from the rear microphone. The electronic time delay circuit of the first electronic processing circuit may furthermore be adapted to receive the rear microphone signal. Preferably, a summing circuit or unit is also provided in the first electronic processing circuit to combine a delayed rear microphone signal from the time delay circuit and the front microphone signal to generate the directional microphone signal. The summing circuit may comprise one or more low-voltage (for hearing aid applications) operational amplifiers constructed in CMOS, Bipolar or BiCMOS technology. For hearing aid applications the first and second electronic processing circuits should be capable of operating with power supply voltages from about 1.50 Volt down to about 0.9 Volt.

An advantage of this preferred embodiment of the invention is that arranging the time delay and summing circuits in the front microphone provides a microphone pair wherein both the front and rear microphone's phase responses correspond to the phase response of a standard microphone, i.e. a microphone of the same type without directional electronic circuitry. Accordingly, both such microphones may be utilised as drop-in replacements for ordinary standard microphones.

To form the directional microphone signal and assembly, the rear microphone signal may be delayed with respect to the front microphone signal with a time delay that approximately equals the acoustic time delay between the inlet ports of the front and rear microphones. Such a time delay generates a cardioid directional pattern for the directional microphone signal. However, the time delay between the rear and front microphone signals may also be selected within the time delay range of 0.33–0.57 times the acoustic time delay between the inlet ports which provide directional microphone signals with supercardioid or hypercardioid directional patterns.

Since, the acoustic time delay between the inlet ports is fixed by the relative positions of the sound inlet ports of the front and rear microphones (and of the direction of sound incidence), it is controlled by the mechanical design of the hearing aid as provided by the manufacturer. Accordingly, it may be advantageous to provide an embodiment of the present directional microphone assembly wherein the time delay of the electronic time delay circuit can be controlled by one or more components external to the microphones. Such an embodiment of the invention allows the electronic equipment manufacturer to control the directional pattern of the communication device in accordance with design preferences and the physical layout of the communication device in question.

According to a preferred embodiment of the invention, an external resistor controls the time delay of the time delay circuit by controlling the cut-off frequency of a low-pass filter that constitutes the time delay circuit. Preferably, this low-pass is a first order filter to provide a relatively simple component and area efficient circuit implementing the time delay. Other and more complex constant delay filter topologies such as all-pass filters, Bessel-type low-pass filters etc. may also be utilised. For a first order low-pass filter, it is preferred that the filter is designed with a cut-off frequency above a pass-band of the rear microphone, such as a cut-off frequency which is 2, 3 or 4 times above the upper cut-off frequency of the rear microphone. For hearing aid applications, the upper cut-off frequency of the rear microphone is typically located about 4–6 kHz but may be as high as about 10 kHz. If the first order low-pass filter is used as the time delay circuit or forms part of the time delay circuit, a single external resistor in series with the input of this low-pass filter can control the electronic time delay or a certain adjustment range for the electronic time delay. For hearing aid applications, the electronic time delay is preferably selected within the range 2–25 $\mu$S, but could be up to about 50–60 $\mu$S for e.g. relatively large BTE hearing instruments with a cardioid directional pattern. In other applications where it is may be feasible to utilise distances between the front and rear microphone inlet ports that are larger than possible for hearing aids, the electronic time delay could be adjusted to correspondingly larger values.

According to a preferred embodiment of the invention, the rear microphone is provided with three externally accessible rear terminals, wherein one of the rear terminals provides the rear microphone signal. The front microphone is provided with four externally accessible front terminals among which one is adapted to receive the rear microphone signal and one provides the directional microphone output signal. The two residual terminals are used as power supply and ground terminals, respectively. In this embodiment, the one or more components external to the microphones is/are arranged in a signal path between the rear terminal providing the rear microphone signal and the front terminal receiving the rear output signal. The one or more components external to the microphones may, as described above, be constituted by a single resistor in series with the rear terminal providing the rear microphone signal so as to control the electronic time delay of the time delay circuit. The one or more components may comprise one or more switches arranged to form a switch arrangement that substantially switch-off the rear microphone signal, thereby providing a directional microphone assembly with programmable directionality. A control terminal of the switch arrangement could be provided to a compatible output port of a hearing aid controller or Digital Signal Processor (DSP) so as to allow the hearing aid DSP, automatically or under control of the hearing aid user, to control ON/OFF states of such a switch arrangement. Alternatively, the control terminal of the switch arrangement could be steered directly by a user operated control button that allows the hearing aid user to manually control the switching between e.g. directional operation and omni-directional operation of his/her hearing aid.

The one or more switches preferably may comprise(s) one or more semiconductors components, such as JFETs, MOSFETs, Bipolar transistors or diodes. The switch or switches could be arranged in series with the signal path between the rear terminal providing the rear microphone signal and the front terminal receiving the rear output signal to open the signal path when activated. Alternatively, the switch or switches could be arranged to short circuit the signal path to ground, or they could be arranged to both open the signal path and short circuit the front terminal receiving the rear output signal to ground so as to prevent noise pick-up of a floating input terminal.

In another embodiment of the invention, the electronic processing circuit of the one microphone that is adapted to receive the signal from the other microphone comprises one or two analogue-to-digital converters adapted to provide digitally encoded front and rear microphone signals. In this embodiment of the invention, the first electronic processing circuit of the front microphone may comprise the one or two analogue-to-digital converters and furthermore be adapted to receive the rear microphone signal in analogue form. If two analogue-to-digital converters are provided, a first converter may be adapted to receive and convert the front microphone signal into a digitally encoded front microphone signal and a second analogue-to-digital converter adapted to receive and convert the rear microphone signal into a digitally encoded rear microphone signal. Alternatively, the front and rear microphone signals could be converted by a single time multiplexed analogue-to-digital converter.

In this embodiment of the invention, the electronic time delay is preferably provided by a digital time delay circuit that generates a delayed digitally encoded rear microphone signal. A summing unit may furthermore be integrated with the first electronic processing circuit to combine the delayed digitally encoded rear microphone signal and the digitally encoded front microphone signal to provide a digitally encoded directional microphone output signal. This embodiment of the invention, may be advantageous for applications in digital signal processing hearing aids which currently are taking over a large part of the hearing aid market. Clearly, it would be advantageous if the digitally encoded directional microphone output signal was encoded according to a standardised communication protocol for transmitting data between a peripheral unit and the hearing aid DSP.

In yet another embodiment of the invention, the second electronic processing circuit of the rear microphone comprises an analogue-to-digital converter converting the rear microphone signal into a digitally encoded rear microphone signal. This digitally encoded rear microphone signal is transmitted to the front microphone that comprises the digital time delay circuit and the summing unit so as to form the digitally encoded directional microphone output signal within the front microphone. Naturally, the rear microphone may instead comprise the digital time delay circuit and the summing unit and adapted to generate the digitally encoded directional microphone output signal on an output terminal.

The front and the rear microphones are preferably both omni-directional microphones. This results in a small package size of the directional microphone assembly, since standard miniature omni-directional microphones for hearing aids, such as Microtronic 6000 and 6300 types of miniature microphones, can be utilised. Alternatively, at least one of the microphones may be a directional microphone.

In a second aspect, the present invention relates to a movable unit comprising a directional microphone assembly according to the first aspect of the present invention. The movable unit may be hearing aids, mobile phones, or head sets etc.

BRIEF DESCRIPTION OF THE DRAWINGS

In the following, a preferred embodiment of a directional microphone assembly according to the invention will be described in more detail with reference to the drawings, wherein.

DETAILED DESCRIPTION OF A PREFERRED EMBODIMENT

Figure 1:
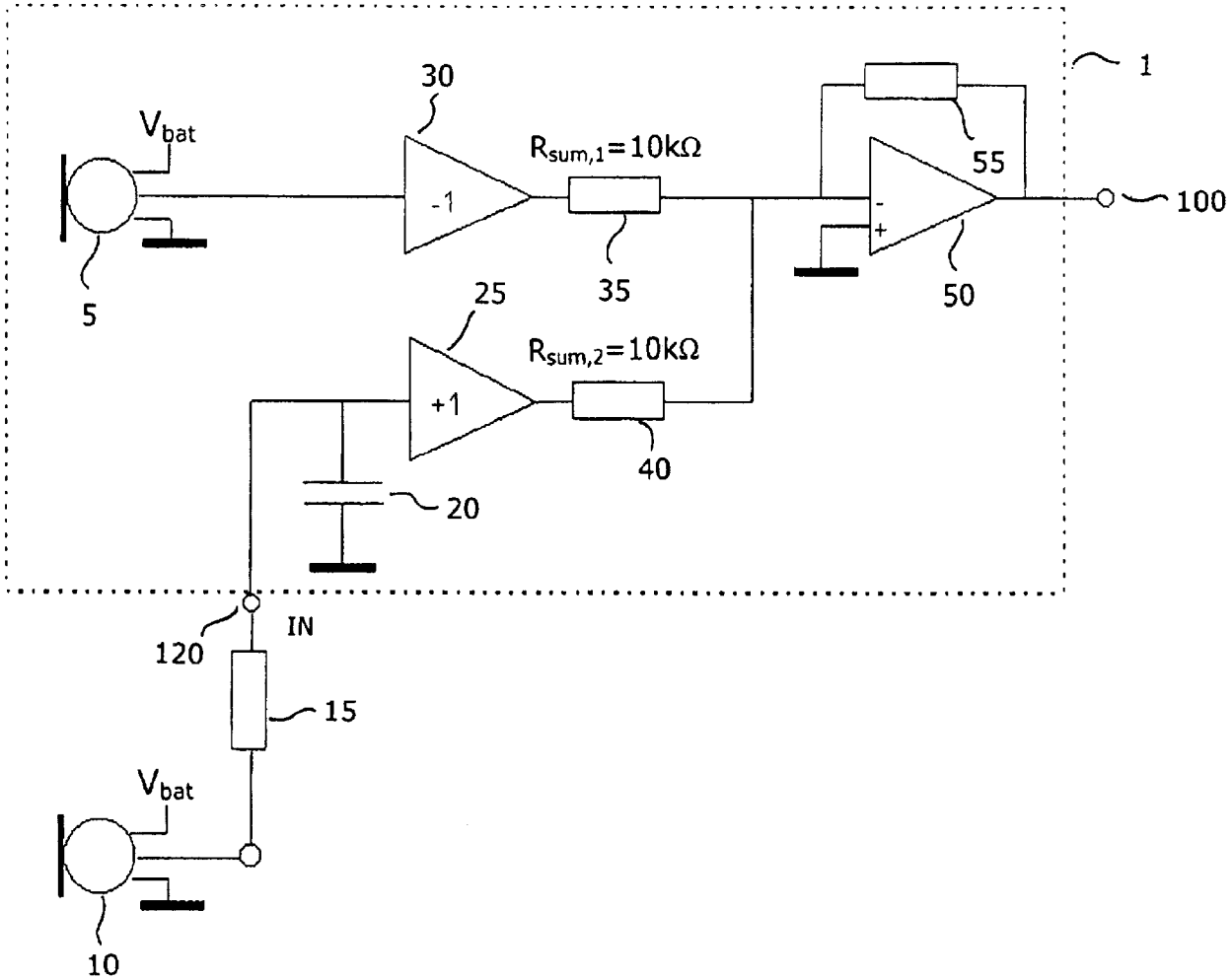
FIG. 1 is a simplified block diagram of a preferred embodiment of a directional microphone assembly according to the invention for hearing aid applications.

FIG. 1 shows a directional microphone assembly comprising a front microphone 5 and a rear microphone 10. Electronic circuitry within a dotted outline 1 constitutes a first electronic processing circuit that is arranged within a casing (105, FIG. 2) of the front microphone 5. A microphone signal of the front microphone 5 is buffered and inverted by unity gain inverter 30 and applied to a first summing resistor 35 of a nominal value of 10 Kohm. An operational amplifier 50 sums, via identical summing resistors 35 and 40, the output signal from the unity gain inverter 30 and an output signal from a low-pass filter formed by a unity gain buffer 25, a capacitor 20 and an external resistor 15. An input signal to the low-pass filter is conveyed over terminal IN 120 from an output terminal (140, FIG. 2) of the rear microphone 10.

Figure 2:
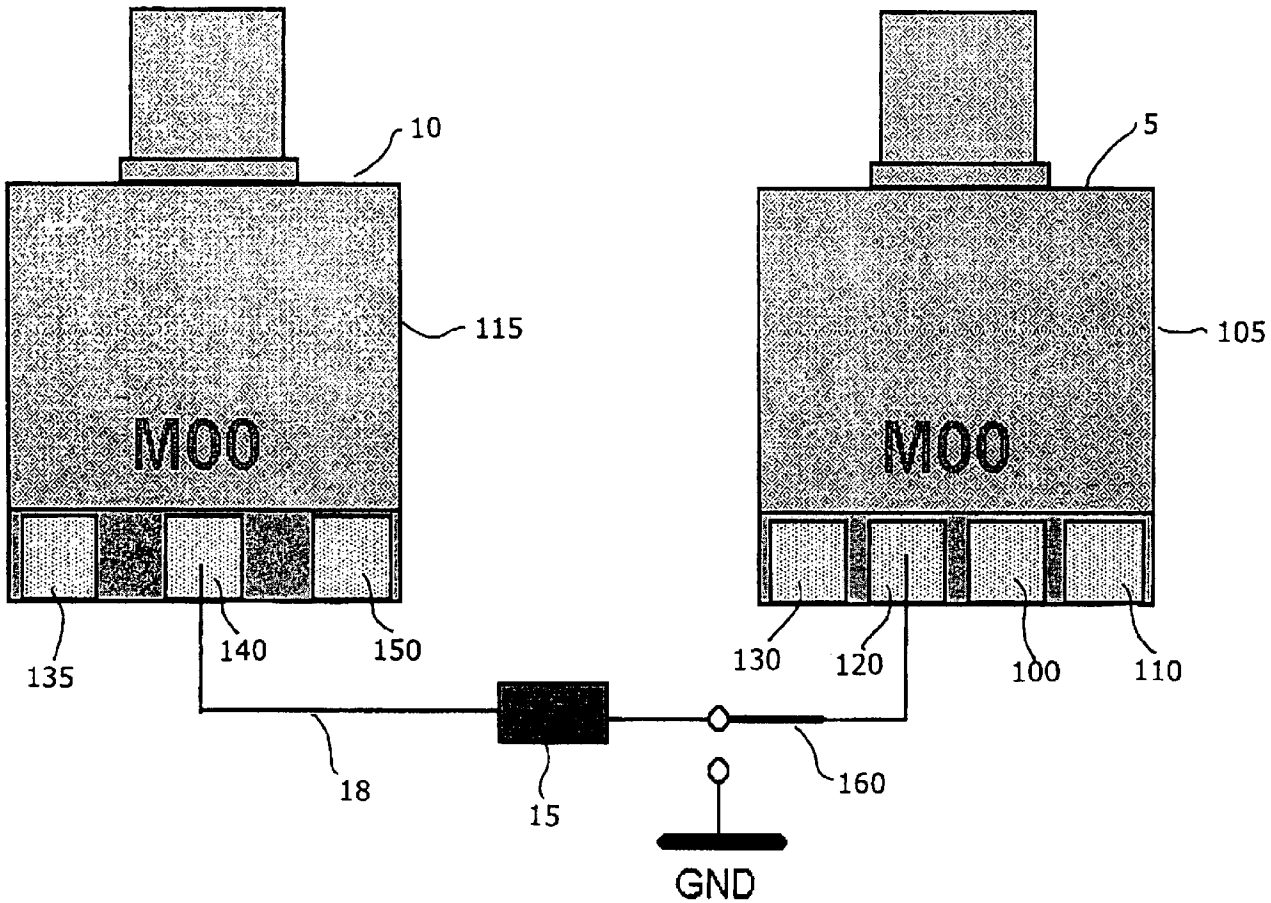
FIG. 2 is an illustration of a directional microphone assembly that allows the adjustment of an electronic time delay with a single external component.

In the present embodiment of the invention, the low-pass filter constitutes an electronic time delay circuit which provides a time delay to the rear micr ophone signal relative to the front microphone signal. Subsequently, a delayed rear microphone signal on the output of unity-gain buffer 25 is added to the front microphone signal and a directional microphone output signal is formed on an output terminal 100 of the front microphone casing 105 (FIG. 2). To provide a good directional response of the present directional microphone assembly, the amplitude and phase responses of the front and rear microphones 5, 10 are, preferably, matched. The required degree of matching depends on the particular application, but for many hearing aid applications, an amplitude matching of about 1 dB or less in the frequency range 200 Hz–4 kHz and a phase matching of about 2 degrees in the same frequency range have been found acceptable. However, since gain and phase mi smatching between the inverting and non-inverting buffers 30, 25, respectively, and mismatch between the summing resistors 35, 40 also contribute to deterioration of the directionality of the directional microphone output signal, these circuit elements are preferably matched to about 1–2%.

In the present embodiment of the invention, the nominal value of summing resistors 25, 30 and the feedback resistor 55 is chosen to 10 Kohm. The nominal value of the external resistor 15 is chosen to 30 Kohm and the value of capacitor 20 is chosen to 330 pF. This selection of component values for the low-pass filter provides a cut-off frequency of about 15 kHz which is significantly higher than the natural upper cut-off frequency of about 6 kHz for the rear microphone 10. The low-pass filter provides a nearly constant time delay of $1/(2*\pi*f_{cut\text{-}off})$, or about 10 $\mu$S for the above component values, in the pass-band of the rear microphone 10. Furthermore, the selected component values strike a reasonable compromise between at one hand keeping the thermal noise contribution of these components at a low level and at the other hand keeping circuit impedance values sufficiently large to avoid having to use an excessive amount of current in the buffers 25, 30 and the operational amplifier 50.

Both the front and rear microphone 5, 10 are preferably buffered through respective customary JFET buffers so as to lower the output impedance of the respective microphone electrect elements to about 3 Kohm.

FIG. 2 illustrates the directional microphone assembly comprising a front microphone 5 with a microphone casing 105 and four externally accessible terminals, 100, 110, 120 and 130 and a rear microphone 10 with a microphone casing 105 and three externally accessible terminals 135, 140 and 150. The directional microphone assembly furthermore comprises the external resistor 15 which as previously explained forms part of the time delay circuit within the front microphone 5. Terminals 150 and 135 of the rear microphone 10 and terminals 110 and 130 of the front microphone are ground and power supply terminals, respectively. The microphones power supply terminals 135 and 130 are preferably connected to a low noise and stable regulated power supply source.

The external resistor 15 controls the electronic time delay of the time delay circuit within the front microphone 5 and can conveniently be inserted in a connection wire 18 between the rear and front microphones. Accordingly, the electronic time delay can conveniently be controlled by setting the value of external resistor 15 to a value that corresponds to the acoustic delay time, or a particular fraction of the acoustic delay time, between the front and rear microphone ports when the directional microphone assembly is mounted in a target hearing aid. Preferably, a manually or automatically controlled switch 160 is inserted in the connection wire 18 to be capable of short circuiting the input terminal 120 to the time delay circuit to ground. Thereby, the directional output signal on terminal 100 is formed solely by the front microphone signal of the omni-directional front microphone 5 and directional effects are eliminated. If the hearing aid processor includes a programmable output port, it is possible to let the processor control the setting of the switch 160 and thus switching between directional and omni-directional operation e.g. in response to a control algorithm stored in the processor.

What is claimed is:

1. A directional microphone assembly comprising:

a front microphone being connected to a first electronic processing circuit, said front microphone being adapted to receive and convert sound waves into a front microphone signal, a rear microphone being connected to a second electronic processing circuit, said rear microphone being adapted to receive and convert sound waves into a rear microphone signal, the second electronic processing circuit being positioned within a casing also housing the front microphone, wherein the first microphone as well as the first and second electronic processing circuits are positioned within a first housing, and the second microphone is positioned in a separate second housing and wherein the first or second electronic processing circuit comprises an electronic time delay circuit adapted to time delay the rear microphone signal with respect to the front microphone signal, and to receive a microphone signal so as to generate a directional microphone output signal, and further wherein that the time delay circuit comprises one component external to the said casing to control the delay.

2. A directional microphone assembly according to claim 1, wherein the first electronic processing circuit of the front microphone comprises the electronic time delay circuit, and wherein the electronic time delay circuit is adapted to receive the rear microphone signal from the rear microphone.

3. A directional microphone assembly according to claim 2, wherein the electronic time delay circuit further comprises a summing circuit adapted to combine a delayed rear microphone signal of the electronic time delay circuit and the front microphone signal so as to generate the directional microphone output signal.

4. A directional microphone assembly according to claim 3, wherein a time delay of the electronic time delay circuit is controlled by one or more external components.

5. A directional microphone assembly according to claim 3, wherein the electronic time delay circuit comprises a low-pass filter.

6. A directional microphone assembly according to claim 4, wherein the time delay of the electronic time delay circuit is controlled by a value of an external resistor.

7. A directional microphone assembly according to claim 4, wherein:

the rear microphone is adapted to provide the rear microphone signal on a rear terminal, the front microphone is adapted to receive the rear microphone signal on a front terminal, and wherein the one or more external components are arranged in a signal path between the rear terminal and the front terminal, thereby allowing the characteristics of the directional microphone output signal to be controlled externally.

8. A directional microphone assembly according to claim 7, wherein the one or more external components comprise one or more switches so as to provide a directional microphone assembly with programmable directionality.

9. A directional microphone assembly according to claim 8, wherein the one or more switches comprise one or more semiconductor components or devices.

10. A directional microphone assembly according to claims 3, wherein the first or the second electronic processing circuit further comprises an analogue-to-digital converter adapted to provide digitally encoded microphone signals.

11. A directional microphone assembly according to claim 10, wherein the electronic time delay circuit is a digital time delay circuit adapted to provide a delayed digitally encoded rear microphone signal, and wherein the summing circuit is adapted to combine the delayed digitally encoded rear microphone signal and the digitally encoded front microphone signal so as to provide a digitally encoded directional microphone output signal.

12. A directional microphone assembly according to claim 1, wherein the second electronic processing circuit of the rear microphone comprises the electronic time delay circuit, the second electronic processing circuit further being adapted to receive the front microphone signal from the front microphone so as to generate the directional microphone output signal.

13. A directional microphone assembly according to claim 12, wherein electronic time delay circuit is a digital time delay circuit.

14. A directional microphone assembly according to claim 1, wherein the front microphone and the rear microphone are omni-directional microphones.

15. A directional microphone assembly according to claim 1, wherein at least one of the microphones is a directional microphone.

16. A movable unit comprising a directional microphone assembly according to claim 1.

17. A movable unit according to claim 16, wherein the movable unit is selected from the group consisting of hearing aids, mobile phones, or head sets.

18. A directional microphone assembly comprising:

a front microphone comprising a first electronic processing circuit, said front microphone being adapted to receive and convert sound waves into a front microphone signal, a rear microphone comprising a second electronic processing circuit, said rear microphone being adapted to receive and convert sound waves into a rear microphone signal, wherein the first or second electronic processing circuit comprises an electronic time delay circuit adapted to time delay the rear microphone signal with respect to the front microphone signal, and to receive a microphone signal so as to generate a directional microphone output signal;

wherein the first electronic processing circuit of the front microphone comprises the electronic time delay circuit, and wherein the electronic time delay circuit is adapted to receive the rear microphone signal from the rear microphone;

wherein the electronic time delay circuit further comprises a summing circuit adapted to combine a delayed rear microphone signal of the electronic time delay circuit and the front microphone signal so as to generate the directional microphone output signal;

wherein the electronic time delay circuit comprises a low-pass filter;

wherein the low-pass filter has a cut-off frequency above a pass-band level of the rear microphone.

* * * * *